US007654334B2

(12) United States Patent
Manson

(10) Patent No.: US 7,654,334 B2
(45) Date of Patent: Feb. 2, 2010

(54) DOWNHOLE TOOL AND RUNNING TOOL SYSTEM FOR RETRIEVABLY SETTING A DOWNHOLE TOOL AT LOCATIONS WITHIN A WELL BORE

(75) Inventor: David John Copeland Manson, South Lake (AU)

(73) Assignee: Peak Well Services Pty Ltd., Bayswater (AU)

( * ) Notice: Subject to any disclaimer, the term of this patent is extended or adjusted under 35 U.S.C. 154(b) by 65 days.

(21) Appl. No.: 11/417,257

(22) Filed: May 4, 2006

(65) Prior Publication Data

US 2006/0272828 A1 Dec. 7, 2006

Related U.S. Application Data

(63) Continuation of application No. PCT/AU2004/001527, filed on Nov. 5, 2004.

(30) Foreign Application Priority Data

Nov. 7, 2003 (AU) ..... 2003906144
Oct. 15, 2004 (AU) ..... 2004905951

(51) Int. Cl.
*E21B 33/129* (2006.01)
*E21B 33/134* (2006.01)

(52) U.S. Cl. ..... 166/387; 166/382; 166/216; 166/123; 166/138

(58) Field of Classification Search ..... 166/382, 166/387, 216, 123, 239, 240, 138, 140
See application file for complete search history.

(56) References Cited

U.S. PATENT DOCUMENTS 2,962,097 A 11/1960 Dollison
3,241,616 A * 3/1966 Cox ..... 166/134
3,398,795 A * 8/1968 Elliston ..... 166/120
3,434,538 A * 3/1969 Pumpelly et al. ..... 166/123
4,432,418 A * 2/1984 Mayland ..... 166/133
4,524,825 A * 6/1985 Fore ..... 166/139
4,648,446 A * 3/1987 Fore et al. ..... 166/123

(Continued)

FOREIGN PATENT DOCUMENTS

AU 703766 6/1997

(Continued)

*Primary Examiner*—Jennifer H Gay
*Assistant Examiner*—Robert E Fuller
(74) *Attorney, Agent, or Firm*—Edell, Shapiro & Finnan, LLC

(57) ABSTRACT

A downhole tool and a running tool are described, each being retrievably settable within a suitably sized cased well bore without the need for any interaction between the downhole tool or the running tool and any restrictions or recesses in the well bore to land, anchor or retrieve either tool. The downhole tool has a mandrel, an anchoring means mounted on the mandrel and controllably reconfigurable from a retracted configuration to permit movement of the downhole tool through the well bore to a radially expanded configuration for releasably engaging the cased well bore. The downhole tool anchoring means is reconfigured using a ratchet that resists movement of the tool anchoring means from the expanded configuration back to the retracted configuration until a release mechanism is released to allow retraction of the downhole tool anchoring means and retrieval of the downhole tool from the well bore.

6 Claims, 13 Drawing Sheets

U.S. PATENT DOCUMENTS

| | | | | |
|---|---|---|---|---|
| 4,823,872 | A | 4/1989 | Hopmann | |
| 4,844,154 | A * | 7/1989 | Ross et al. | 166/139 |
| 4,848,469 | A * | 7/1989 | Baugh et al. | 166/382 |
| 5,366,010 | A | 11/1994 | Zwart | |
| 6,220,348 | B1 * | 4/2001 | Serafin et al. | 166/133 |
| 6,334,487 | B1 * | 1/2002 | Adkins et al. | 166/55.7 |
| 6,540,019 | B2 * | 4/2003 | Willauer | 166/119 |
| 2002/0062962 | A1 * | 5/2002 | Gary et al. | 166/305.1 |

FOREIGN PATENT DOCUMENTS

| | | | |
|---|---|---|---|
| GB | 2170247 | A | 8/1985 |

* cited by examiner

DOWNHOLE TOOL AND RUNNING TOOL SYSTEM FOR RETRIEVABLY SETTING A DOWNHOLE TOOL AT LOCATIONS WITHIN A WELL BORE

CROSS REFERENCE TO RELATED APPLICATIONS

This application is a continuation of PCT/AU2004/001527, filed Nov. 5, 2004, and titled "A Retrievable Downhole Tool and Running Tool," which claims priority to Australian Application No. AU 2003906144, filed on Nov. 7, 2003, and to Australian Application No. AU 2004905951, filed on Oct. 15, 2004, the entire contents of which are hereby incorporated by reference.

FIELD OF THE INVENTION

The present invention relates to a well tool that is settable at any location within the bore of a well and can be subsequently retrieved to the surface. The present invention further relates to a running tool for running and setting a retrievable well tool.

The running tool and/or well tool of the present invention may be used in any type of cased well, including sub-sea wells, platform wells and land wells. The present invention relates particularly, though not exclusively to wells used for oil and/or gas production, but is also applicable to gas and/or water injection wells.

BACKGROUND OF THE INVENTION

It is common practice to run, land, set and retrieve downhole tools within the borehole of a well to perform various functions including sealing the bore of the well or for carrying a measuring device for monitoring parameters such as pressure or temperature within the well. Typically the borehole of a well is cased using drillpipe, casing or tubing string which is designed in such as way as to provide predetermined locations for landing and setting such downhole tools.

Conventionally, downhole tools are landed and set at specific predetermined locations by relying on the interaction between the tool and a restriction or "no-go shoulder" of reduced cross-section in the well bore in the form of a landing or locating nipple. Typically the no-go shoulder provides a surface that restricts further downward passage of the tool. Force can then be applied to the tool to actuate the latch dogs and set the tool at a predetermined location along the length of the well bore. Alternatively, downhole tools and measuring devices are run into the bore of a well and landed in a so-called "side pocket mandrel" which has been installed as part of the drillpipe or tubing string when the well was cased. A side pocket mandrel typically has a main bore aligned with the bore of the drillpipe and a receptacle bore laterally offset from the main bore and extending alongside thereof. The receptacle bore typically has an electrical contact or prong in one end which is electrically connected to suitable equipment at the surface. Side pocket mandrels can be used for locating measuring devices used to monitor parameters such as downhole pressure and temperature whilst allowing other downhole tools to be lowered into the well. Side pocket mandrels are 99% used for gas injection or chemical injection. A retrievable valve is located in the side pocket which controls the flow of chemical or gas from the annulus to the production tubing.

Examples of downhole tools which are actuated by interaction with a restriction in a cased well bore are described in U.S. Pat. No. 4,823,872 (Hopmann) and AU703766 (McLeod). Examples of running tools which are used to position a tool in a side pocket mandrel are described in GB 2170247 (Schnatzmeyer) and U.S. Pat. No. 2,962,097 (Dollison).

Typically a running tool is used to land and set other downhole tools in a well. Once set, the downhole tool may be left in place for several hours or several days, while the running tool is retrieved to the surface. In recent times, running tools and downhole tools have been designed to be lowered, manipulated and retrieved using a conventional single or multi-strand electric cable known as 'wire line' or a single strand non-electric cable known as 'slickline'.

Using traditional tools, it only possible to set the tools at the pre-determined locations where a landing nipple or side pocket mandrel has been pre-installed. The locations of the side pocket mandrels and landing nipples are fixed at the time when the well is designed and installed and add to the cost of designing the well. Moreover, in order to provide a plurality of landing nipples, the internal diameter of the casing becomes progressively narrower, making it increasingly difficult to accommodate and manipulate downhole equipment. Any restriction in the diameter of, in particular, a lower section of a well bore makes operation of the well more difficult and may lead to a significant loss of potential production from the reservoir. This loss of production is due to a pressure drop created across each well bore restriction. The smaller the restriction the greater the drop in pressure and the greater the drop in production rate as a result.

One type of downhole tool that may be landed, set and retrieved in a well bore is a bridge plug. A bridge plug is a device that is set across the bore of a cased well to test the pressure integrity of, isolate, or seal a section of the well bore. Bridge plugs may also be used to straddle a section of a cased well that has been perforated to flow test a formation. The bridge plug may be set as a permanent measure or be retrievable.

To perform the function of a bridge plug, the downhole tool must be able to be anchored in its set position in the well bore and form a seal to isolate a section of a cased well bore. Traditionally, bridge plugs are provided with an anchoring means on the plug itself arranged to engage at any depth within a given tubing internal diameter. Conventional bridge plugs require considerable force to be used to set the plug and to provide the necessary seal between the plug and the internal diameter of the cased well bore. This force is traditionally provided using explosive charges.

An alternative to traditional bridge downhole tools is described in U.S. Pat. No. 5,366,010 (Zwart). Zwart describes a retrievable bridge plug and running tool which can be set using wireline or slickline. The bridge plug of Zwart is provided with upper and lower sets of toothed locking slips which are movable into a radially extended bore wall engaging position by application of a downward force to a central sleeve along which an upper and lower member are axially slidable. After setting of the upper and lower slips, the bridge downhole tool of Zwart is brought into sealing engagement with the bore wall by application of an upward force to the lower member to compress a sealing means located between the upper and lower slips.

The Zwart design has several problems. The complex arrangement of nested sleeves results in a concomitant reduction in the internal diameter of the downhole tool itself. This makes it difficult to accommodate the passage of other downhole equipment through the hollow bore of the Zwart bridge plug to a lower level. The reduced bore of the Zwart bridge plug also restricts production flow through the internal diameter of the set bridge plug. The setting and retrieval operations of the Zwart bridge plug are quite complex, the Zwart bridge plug being provided with a large number of shear pins each of which control relative axial movement of a series of nested sleeves, the setting and retrieval operations requiring a complex series of upward and downward forces to be applied in a particular sequence to shear the pins in a particular order. Given that bridge plugs can be deployed at large depths down a well bore, it can be extremely difficult for a operator at the surface to determine whether or not the setting or retrieval operation is progressing as required when using the Zwart bridge plug. The present invention was developed to provide an alternative settable retrievable downhole tool that can be located at any depth within a well bore without needing an interaction between the well tool and a restriction or recesses within the well bore to land, set or retrieve the downhole tool.

It will be clearly understood that, although prior art use and publications are referred to herein, this reference does not constitute an admission that any of these form a part of the common general knowledge in the art in Australia or in any other country.

In the statement of invention and description of the invention which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

SUMMARY OF THE INVENTION

According to a first aspect of the invention there is provided a downhole tool retrievably settable within a suitably sized cased well bore, the downhole tool comprising:

a mandrel;

a downhole tool anchoring means mounted on the mandrel and reconfigurable from a retracted configuration to permit movement of the downhole tool through the well bore to a radially expanded configuration for releasably engaging the cased well bore, the downhole tool anchoring means being biased towards the retracted configuration;

a downhole tool setting means for resisting movement of the tool anchoring means from the expanded configuration back to the retracted configuration until a release mechanism is released to allow retraction of the downhole tool anchoring means and retrieval of the downhole tool from the well bore; and, one or more locking means for locking the downhole tool anchoring means in the retracted configuration after the release mechanism has been released.

In one embodiment, the downhole anchoring means is reconfigured from the retracted configuration to the radially expanded configuration upon application of an axial force. Preferably, the downhole anchoring means is a set of bi-directional slips.

In one embodiment the downhole tool setting means is a ratchet.

Preferably, the release means is arranged for engagement with a fishing tool and operable thereby to permit release of the downhole tool setting means allowing the downhole tool anchoring means to retract into the retracted configuration for retrieval of the downhole tool.

In one embodiment, the downhole tool further comprises a sealing means for providing a fluid seal between the downhole tool and the well bore such that the downhole tool operates as a plug. Preferably, the sealing means is controllably reconfigurable from a retracted configuration to permit movement of the downhole tool through a well bore and a radially expanded configuration for sealing engagement with the bore wall. More preferably, the sealing means is expanded into sealing engagement with the bore wall by applying a repeated compressive force to the sealing means after the downhole tool anchoring means has been expanded into engagement with the well bore.

Advantageously the downhole tool anchoring means are positioned below the downhole tool sealing means so that debris may not fall below the sealing means and foul the downhole tool anchoring means. When the downhole tool is provided with a sealing means, the downhole tool may further comprises a pressure equalisation means for equalising any pressure differential that may exist across the downhole tool prior to retrieval.

The downhole tool may further comprise a downhole tool setting release means releasable from a locked configuration in which expansion of the downhole tool sealing and/or anchoring means is prevented to a released configuration in which expansion of the downhole tool sealing and/or anchoring means is permitted. Preferably, the downhole tool setting means is in the form of one or more shear pins, shear screws or snap rings.

The downhole tool may be used in combination with a running tool for landing and reconfiguring the tool in the well, the downhole tool being releasably coupled to the running tool.

In an alternative embodiment, the downhole tool further comprises a measuring device for monitoring one or more well parameters. Preferably the measuring device is suspended from the downhole tool and the mandrel of the downhole tool is hollow to permit the flow of fluids therethrough.

According to a second aspect of the present invention there is provided a running tool for landing and setting a retrievable downhole tool at any location in a well bore, the running tool comprising:

an inner rod;

a running tool anchoring means mounted on the inner rod and controllably reconfigurable between a retracted configuration to permit movement of the tool through the well bore and a radially extended configuration for locking engagement of the running tool with the bore wall;

a running tool actuating assembly for effecting reciprocal movement of the reconfiguring the running tool anchoring means to and from the retracted and expanded configurations without interacting with any restrictions or recesses within the well bore; the tool actuating assembly being moveable from a first configuration in which the tool anchoring means is retracted and a second configuration in which the tool anchoring means is expanded in response to the application of an axial force; and, a resistance means for frictionally engaging the bore wall with sufficient gripping force so as to hold the position of the running tool relative to the well bore during movement of the running tool actuating assembly to and from the first and second configuration upon application of the axial force.

Preferably the running tool anchoring means is in the form of a set of slips cooperating with at lease one expansion cone, each slips provided with a plurality of teeth directed to resist downward movement of the running tool when the running tool anchoring means is in the expanded configuration. Advantageously, the resistance means has a fixed end and an axially slidable end to accommodate movement of the running tool past any restrictions in the well bore during setting and/or retrieval of the running tool. In one embodiment, the resistance means is one ore more bow springs.

To assist in retrieval of the running tool, the running tool anchoring means may be biased towards the retracted configuration.

Preferably, the running tool actuating assembly is a J-slot mechanism comprising an actuating pin receivable in a J-slot profile, the J-slot profile having one ore more short legs and one ore more long legs, the actuating pin being constrained to move between a short leg and a long leg upon application of an axial pulling force to the tool actuating assembly, whereby when the actuating pin is located in one of the short legs the tool anchoring assembly is in the first configuration and when the actuating pin is located in one of the long legs the tool anchoring assembly is in the second configuration. Alternatively, the running tool actuating assembly comprises a J-slot mechanism comprising an actuating pin receivable in a J-slot profile, the J-slot profile having one ore more short legs and one ore more long legs, the actuating pin being constrained to move between a long leg and a short leg upon application of an axial pushing force to the tool actuating assembly, whereby when the actuating pin is located in one of the long legs the tool anchoring assembly is in the first configuration and when the actuating pin is located in one of the short legs the tool anchoring assembly is in the second configuration.

According to a third aspect of the present invention there is provided a downhole tool/running tool system for retrievably setting the downhole tool at any location within a well bore, the system comprising:

a running tool comprising an inner rod, a running tool anchoring means mounted on the inner rod and controllably reconfigurable between a retracted configuration to permit movement of the tool through the well bore and a radially extended configuration for locking engagement of the running tool with the bore wall, a running tool actuating assembly for effecting reciprocal movement of the reconfiguring the running tool anchoring means to and from the retracted and expanded configurations without interacting with any restrictions or recesses within the well bore, the tool actuating assembly being moveable from a first configuration in which the tool anchoring means is retracted and a second configuration in which the tool anchoring means is expanded in response to the application of an axial force, and, a resistance means for frictionally engaging the bore wall with sufficient gripping force so as to hold the position of the running tool relative to the well bore during movement of the running tool actuating assembly to and from the first and second configuration upon application of the axial force;

a downhole tool comprising a mandrel, a downhole tool anchoring means mounted on the mandrel and reconfigurable from a retracted configuration to permit movement of the downhole tool through the well bore to a radially expanded configuration for releasably engaging the cased well bore, the downhole tool anchoring means being biased towards the retracted configuration, and, a downhole tool setting means for resisting movement of the tool anchoring means from the expanded configuration back to the retracted configuration until a release mechanism is released to allow retraction of the downhole tool anchoring means and retrieval of the downhole tool from the well bore; and, means for releasably coupling the downhole tool with the running tool, said means facilitating transfer of axial loads between the running tool and downhole tool during landing and setting of the downhole tool in the well bore and arranged to release the running tool from the downhole tool upon application of an upward jarring force.

Preferably the means for releasably coupling the downhole tool with the running tool includes one or more load transfer keys axially moveable along a keyway in response to the application of an axial force whereby an axial force applied to the running tool is transmitted to the downhole tool.

In one embodiment, the downhole tool of the system further comprises a downhole tool sealing means mounted on the mandrel and moveable from a retracted configuration to permit movement of the downhole tool through a well bore and a radially expanded configuration for sealing engagement with the bore wall. In this embodiment, the system may further comprise one or more seals in combination with the sealing means for ensuring pressure integrity across the downhole tool sealing means when the downhole tool sealing means is in the radially expanded configuration.

In an alternative embodiment, the downhole tool/running tool system further comprises a measuring device for monitoring one or more well parameters.

According to a fourth aspect of the present invention there is provided a method of setting a downhole tool in a bore, the method comprising the steps of a) coupling the downhole tool with the running tool so as to form a running tool/downhole tool assembly;

b) running the running tool/downhole tool assembly into the bore of a well to any desired location within the well bore, the running tool anchoring means and the downhole tool anchoring means being in their respective retracted configurations;

c) applying an axial force in a first direction to the running tool so as to reconfigure the running tool anchoring assembly into the expanded configuration;

d) thereafter applying an axial force in a second direction to reconfigure the downhole tool anchoring assembly into the expanded configuration in engagement with the bore wall so as to set the position of the downhole tool within the well bore; and e) thereafter releasing the running tool from the downhole tool for retrieval of the running tool from the well bore.

BRIEF DESCRIPTION OF THE DRAWINGS

In order to facilitate a more comprehensive understanding of the nature of the invention, embodiments of the downhole tools in accordance with the various aspects of the invention will now be described in detail, by way of example only, with reference to the accompanying drawings, in which.

DETAILED DESCRIPTION

Before the preferred embodiments of the present tools are described, it is to be understood that the present invention is not limited to the particular types of anchoring, setting and/or sealing means described. It is also to be understood that the terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs.

Throughout this specification reference is made to the tools being set in a "well bore". The term "well bore" refers to a cased well lined with one or more strings of drillpipe or tubing. Thus, reference to engagement of a component with the well bore refers to engagement of the component with the internal diameter of the tubular used to line and/or case the well bore.

The term "downhole tool" is used to describe a tool that is set in position in the well bore and remains in place for a period of time. The term "running tool" is used to describe a tool that is used to run, land or anchor, and set the downhole tool in the well bore, the running tool then being retrieved to the surface.

The present invention is particularly suited for use in a "monobore" well which is a well bore for which the internal diameter remains substantially constant along its length. This type of well bore completion string is the cheapest type and being able to use a monobore well obviates the need to anticipate the location of shoulders and keys for landing prior art type downhole tools or instruments. It is considered that a person skilled in the art to which the present invention belongs will appreciate that the size of the outer diameter of the tool(s) will need to be selected to match the internal diameter of the well bore in such a way that the tool(s) can pass through the well bore to reach a desired location in the well when the anchoring and/or sealing means described below are in their respective retracted configurations and that the anchoring and/or sealing means are able to be brought into engagement with the internal diameter of the well bore when configured into their respective expanded configuration. Thus, selecting the correct size of tool(s) required for a given well design is considered to be a matter of routine.

Figure 13:
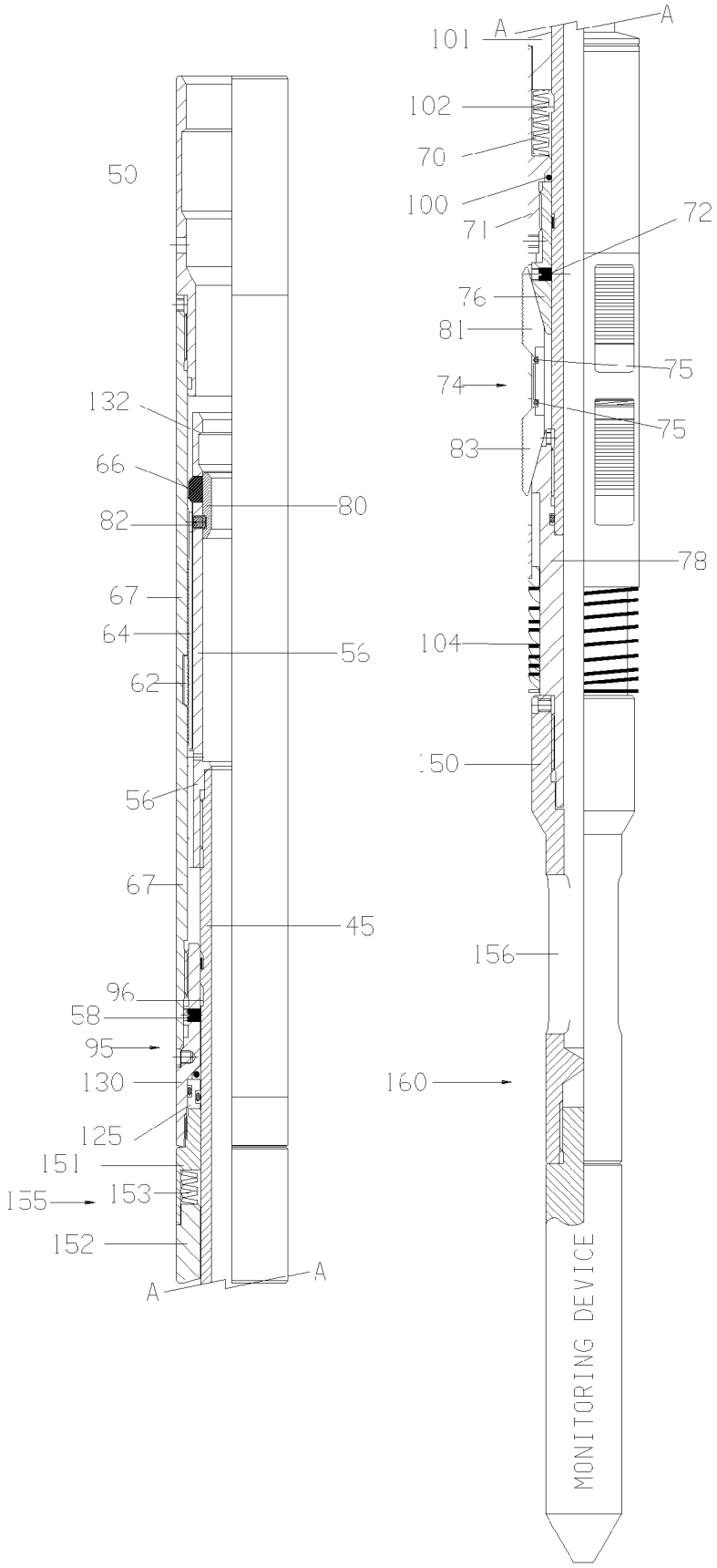

It is to be clearly understood that the present invention is equally applicable to sub-sea, land wells, and platform wells for oil and gas production as well as water injection and production wells and wells used for waste disposal. In the interest of clarity, the illustrations have been split into a plurality of sections. Preferred embodiments are now described in detail with reference to a downhole tool being releasably coupled with a running tool to form a running tool/downhole tool system. In the first described embodiment illustrated in FIGS. 1 to 12, the downhole tool is provided with a sealing means so as to perform the function of a bridge plug. In FIG. 13, the downhole tool does not include a sealing means but rather is fitted with a measuring device for monitoring one or more well parameters such as downhole pressure, temperature, flow rates or the like. In this embodiment, fluids such as hydrocarbons, oil, gas or water can flow through and around the set downhole tool.

Referring to FIGS. 1 to 6, in the first described embodiment, a retrievable downhole tool 10 in the form of a bridge plug is releasably coupled to a running tool 12 so as to form a downhole tool assembly. In each of these figures the uppermost ends of the bridge plug 10 and running tool 12 are shown towards the left-hand upper edge of each of the drawing sheets.

Figure 1:
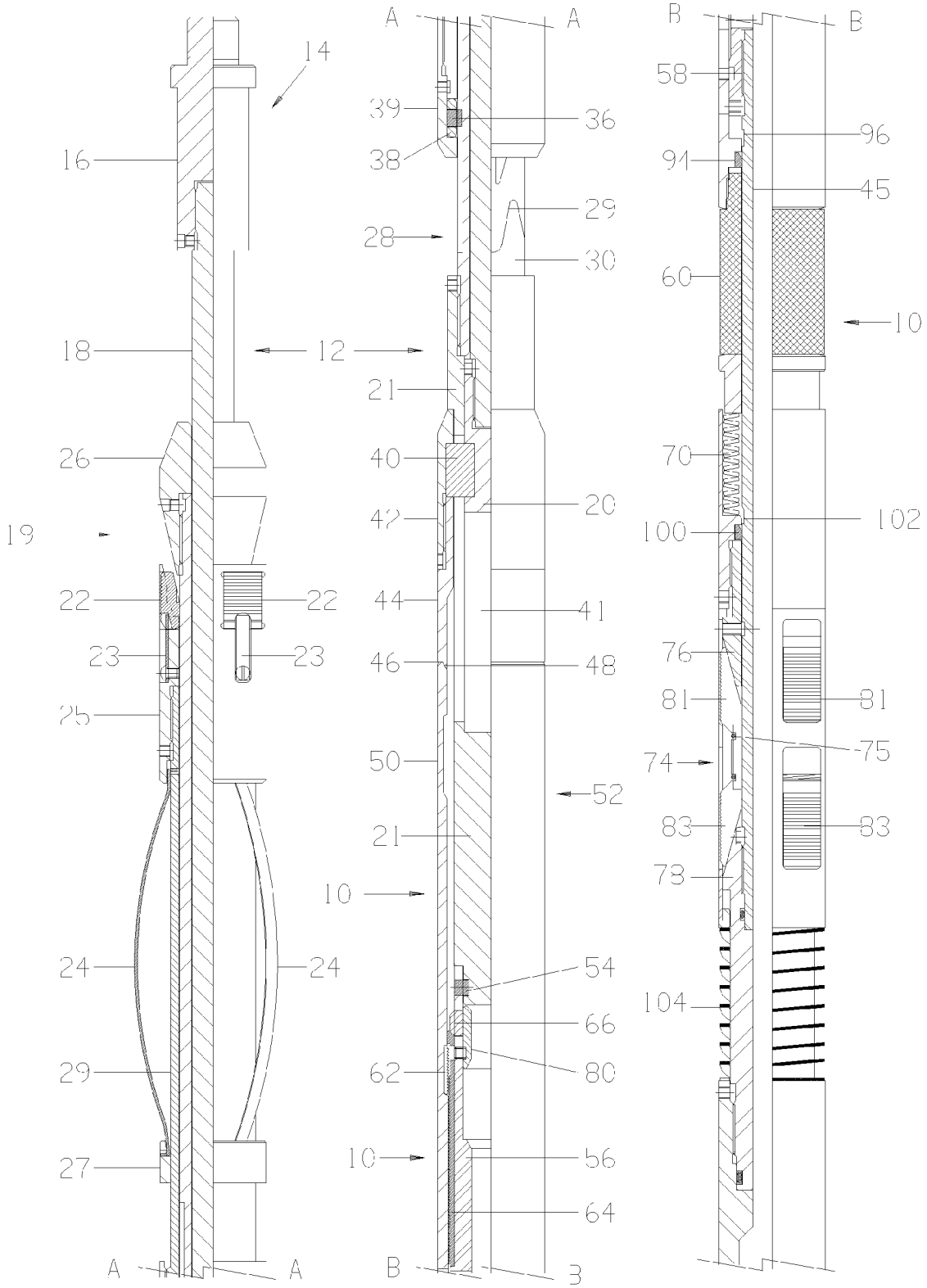
FIG. 1 is split into three portions for the interest of clarity and provides a half-sectional view of a first embodiment of a running tool and bridge plug assembly shown in a configuration suitable for running the assembly into a well bore, where lines A-A and B-B shown at the corresponding ends of adjacent portions in FIG. 1 represent a break and continuation between the corresponding ends.

In FIG. 1, the bridge plug 10 and running tool 12 are each shown in a retracted configuration suitable for running the assembly downhole. The running tool 12 has an upper end 14 fitted with a collar 16 referred to in the art as a 'top sub' and a lower end fitted with a bottom sub 20. The top sub 16 is provide for attachment of wireline, slickline or coiled tubing (not shown) to the upper end 14 of the running tool 12. The wireline, slickline or coiled tubing is used to manipulate the running tool 12 to set the position of the bridge plug 10 in the well bore.

The top sub 16 and lower sub 20 are each mechanically coupled to an inner rod 18 which extends co-axially along the length of the running tool 12 between the top sub 16 and a lower sub 20. The lower sub 20 is contained within a slotted sub 21 which is releasably coupled to the bridge plug 10 as described in greater detail below.

Figure 2:
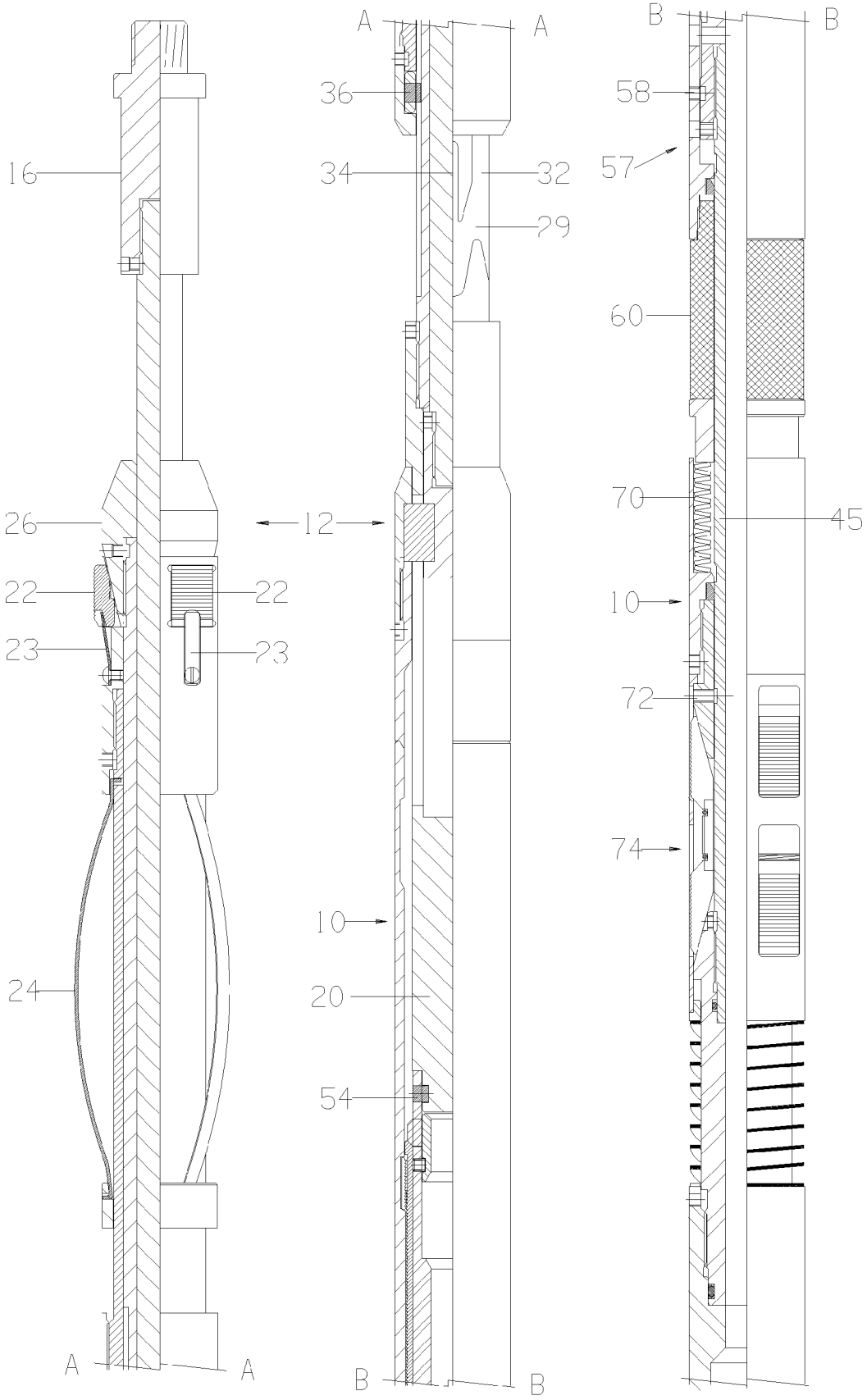
FIG. 2 is split into three portions for the interest of clarity and provides a half-sectional view of the running tool and bridge plug assembly of FIG. 1 shown in a configuration suitable for landing the assembly in the well bore, where lines A-A and B-B shown at the corresponding ends of adjacent portions in FIG. 2 represent a break and continuation between the corresponding ends.

The running tool 12 is provided with a running tool anchoring means 22 in the form of a set of toothed slips mounted on the inner rod 18 and reconfigurable between a retracted configuration shown in FIG. 1 to permit movement of the running tool 12 through the well bore and a radially extended configuration for locking engagement of the running tool with the bore wall as shown in FIG. 2. When the running tool slips 22 is in its radially extended configuration, as illustrated in FIG. 2, the weight of the running tool 12 and bridge plug 10 is suspended from the expanded running tool slips 22.

When the running tool slips 22 are in the retracted configuration shown in FIG. 1, the external diameter of the running tool 12 is less than the internal diameter of the well bore. The running tool slips 22 are biased towards this retracted configuration using biasing means 23 in the form of flat springs 23. The running tool slips 22 are held on the J-mandrel by means of a slips retaining sleeve 25. Expansion of the running tool slips 22 into the expanded configuration of FIG. 2 occurs by causing axial movement of the running tool slips 22 towards a slips expansion cone 26. The frustoconical shape of the slips expansion cone 26 forces radial outward movement of the running tool slips 22 into its extended configuration thereby bringing the running tool slips 22 into locking engagement with the bore wall.

Movement of the running tool slips 22 relative to the slips expansion cone is controlled by reconfiguring a running tool anchor actuating assembly 19 from a first configuration in which the running tool slips 22 are spaced apart from the slips expansion cone 26 and thus retracted as shown in FIG. 1, and a second configuration in which the running tool slips 22 are moved towards the slips expansion cone 26 and are thereby expanded as shown in FIG. 2.

Reconfiguration of the running tool anchor actuating assembly 19 between the first and second configurations is achieved by the application of an upward pulling force to the running tool 12 using a wireline (not shown) attached to the top sub 16. Repeated application of an upward axial pulling force and downward movement causes the running tool anchor actuating assembly 19 to repeatedly switch between the first and second configurations in a controlled manner as described below.

In the illustrated examples, the running tool anchor actuating assembly 19 is provided in the form of a continuous J-slot mechanism comprising an actuating cam or pin 36 which is caused to travel along a continuous J-slot profile 29 machined into a J-slot mandrel 30 coaxial with the inner rod 18. The actuating pin 36 extends outwardly from a J-pin bearing 38 which is mounted on and rotatable about the J-slot mandrel 30 and retained thereon by a J-pin bearing retaining means 39.

The J-slot profile 29 (best seen in FIG. 2) has a continuous alternating series of long legs 32 and short legs 34, the particular sequence of long and short legs not being critical to the working of the present invention provided only that legs of differing length are provided within the J-slot profile 29. The J-slot mechanism 28 may equally have the actuating pin 36 extending from the J-slot mandrel 30 with the J-slot profile 29 being provided in a sleeve or sleeves (not shown) co-axially mounted on the J-slot mandrel 30 and able to rotate about the inner rod 18. The J-slot mechanism could also equally be reversed such that an axial pushing force would be required to move the actuating pin from one of the long legs to one of the short legs, thereby moving the running tool actuating assembly from the first configuration to the second configuration.

Using the illustrated example, when the actuating pin 36 is positioned in one of the short legs 34 of the continuous J-slot profile 29, the running tool anchor actuating assembly 19 is locked in its first configuration and the running tool slips 22 are retracted to allow passage of the running tool 12 through the well bore. When the actuating pin 36 is moved such that it is located within one of the long legs 36 of the continuous J-slot profile 29, the running tool anchor actuating assembly 19 is in its second configuration in which the running tool slips 22 are expanded into locking engagement with the internal diameter of the cased well bore. The relative length of the long and short legs 32 and 34, respectively, are chosen according to the relative displacement of the running tool slips 22 from the expansion cone 26 in such a way that the running tool slips 22 are spaced apart from the slips expansion cone 26 when the actuating pin 36 is located in one of the short legs 34 and the running tool slips 22 are expanded onto the slips expansion cone 26 when the actuating pin is located within one of the long legs 32.

The running tool 12 of the present invention is able to be landed and anchored at any depth within a suitably sized well bore without the need to interact with any recesses or restrictions provided within the well bore. To provide the reaction force required to manipulate the running tool anchor actuating assembly 19 by wireline, the running tool 12 is provided with a resistance means 24. The resistance means 24 frictionally engages the bore wall with sufficient gripping force so as to hold the position of the running tool relative the bore wall when the axial pulling force is applied to actuate the running tool anchor actuating assembly 19. In the illustrated example, the resistance means 24 comprises a set of three radially spaced and axially oriented bow springs located at 120° separation relative to each other around the circumference of the running tool 12. The resistance means may equally take the form of one or more spring loaded drag block(s) or any other number of bow springs, provided only that the resistance means 24 is capable of generating sufficient gripping force to counterbalance the axial force used to reconfigure the running tool anchor actuating assembly 19. The amount of frictional drag between the bow springs 24 and the internal diameter of the cased well bore may be adjusted by addition of a coil spring and an adjustable threaded spring compression device (not shown). In this example, one end of the bow springs 24 is fixed whilst the other is provided with a floating ring 27 retained by a bow spring sleeve 29 which is coaxially mounted on and axially slidable relative to the J-mandrel 30. The floating ring 27 allows compression of the bow springs 24 as the running tool passes through any restrictions in the well bore during running and/or retrieval operations.

In use, to running tool 12 is provided in its retracted configuration with the running tool anchor actuating assembly 19 in its first configuration, and run into the well bore to any desired depth. The actuating pin 36 is located in one of the short legs 34 of the J-slot profile 29. On reaching a desired location in the well, the tool anchor actuating assembly 19 is moved into its second configuration in which the actuating pin is located in one of the long legs 36 by applying an upward pulling force through a wireline (not shown) attached to the top sub 16 to move the actuating pin 36 out of one of the short legs 34. Subsequent release of the upward pulling force caused the actuating pin 36 to track across the J-slot profile 29 into one of the long legs 32 thereby moving the running tool anchor actuating assembly 19 into its second configuration. The bow springs 24 of the running tool 12 provide sufficient gripping force to hold the running tool 12 in position while the running tool anchor actuating assembly 19 is being reconfigured. When the running tool anchor actuating assembly 19 is in its second configuration, the running tool slips 22 have been brought into locking engagement with the bore wall.

The running tool slips 22 comprise a set of three replaceable steel wedges that, in the extended configuration, together form a near-circle around the well bore. The replaceable steel wedges are provided with hardened teeth that embed slightly into the bore wall. Application of further downward force to the running tool 12 assists in increasing the biting force applied, fixing the running tool more securely in position in the bore wall. The teeth of the running tool slips 22 are angled for locking engagement of the running tool slips 22 with the bore wall in one direction only, namely downwardly, to allow ease of retrieval of the running tool 12. It is to be understood, however, that the teeth of the running tool slips 22 could equally be angled bi-directionally if desired.

Figure 3:
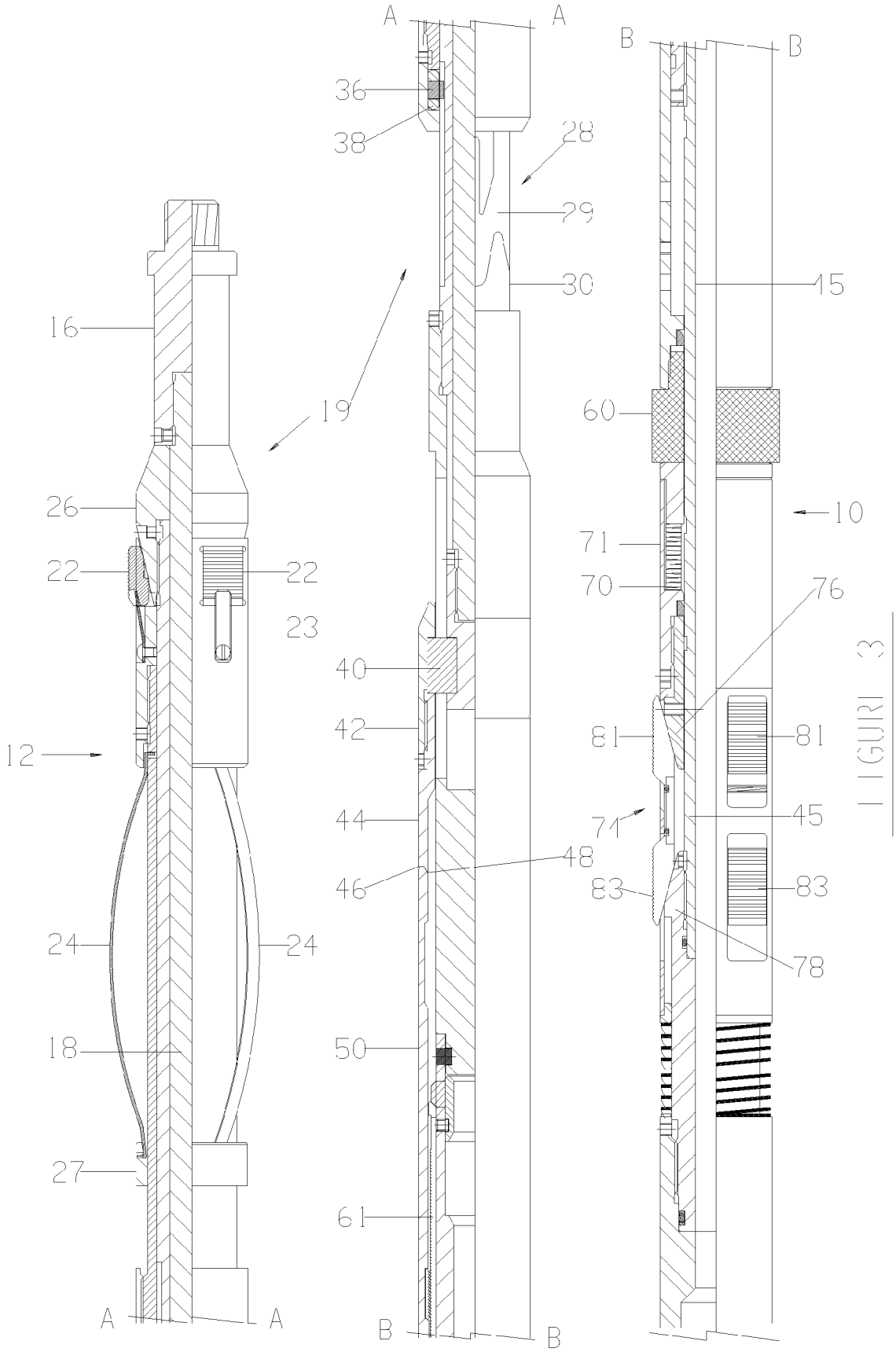
FIG. 3 is split into three portions for the interest of clarity and provides a half-sectional view of the running tool and bridge plug assembly of FIG. 1 shown in a configuration suitable for setting the bridge plug anchoring and sealing means in the well bore, where lines A-A and B-B shown at the corresponding ends of adjacent portions in FIG. 3 represent a break and continuation between the corresponding ends.
Figure 4:
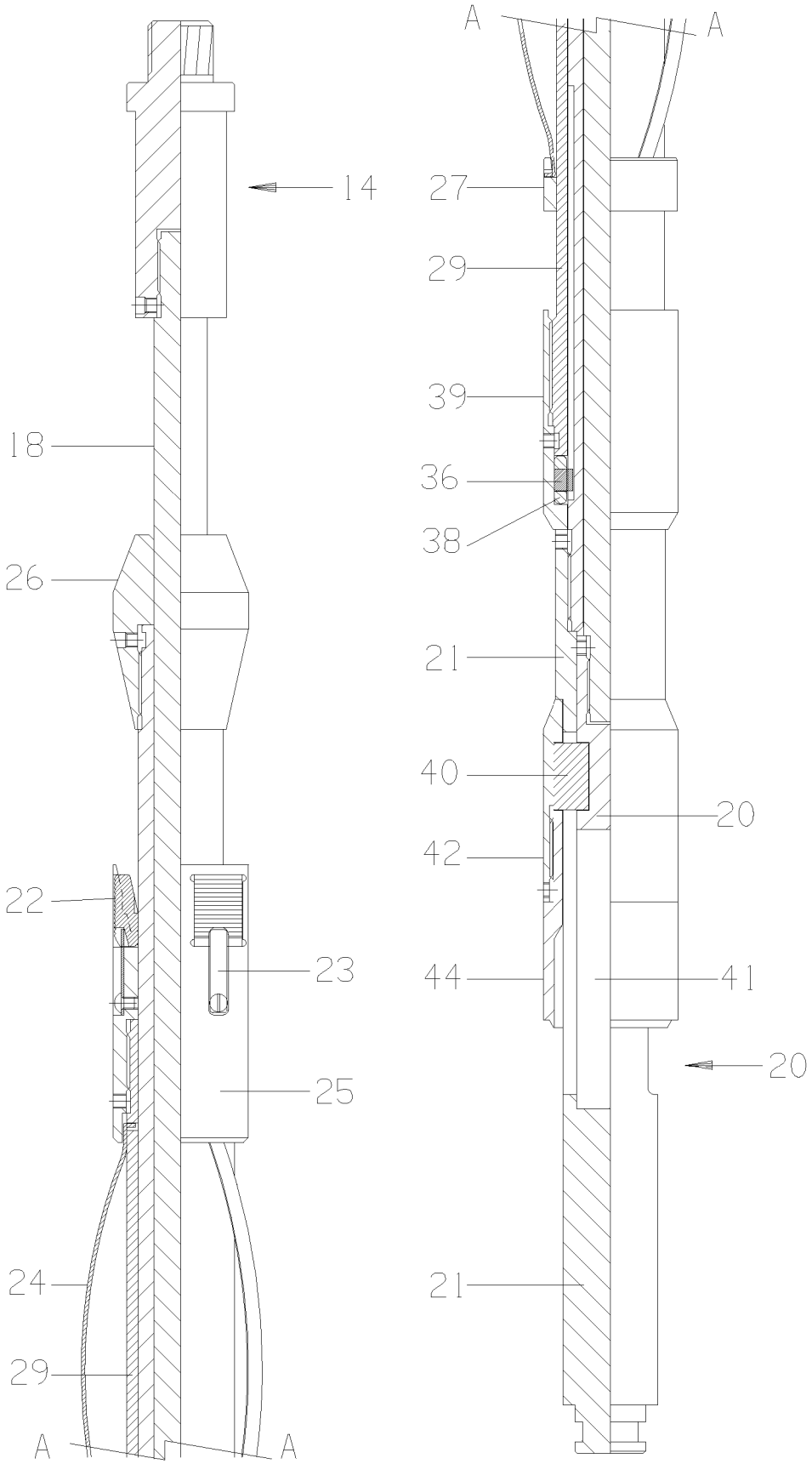
FIG. 4 is split into two portions for the interest of clarity and provides a half-sectional view of the running tool and bridge plug assembly of FIG. 1 shown in a configuration suitable for retrieval of the running tool from its set position in the well bore, where line A-A shown at the ends of the two portions in FIG. 4 represents a break and continuation between the corresponding ends.

With reference to FIG. 3, release of the running tool slips 22 from the expanded configuration is achieved by application of a second upward pulling force so as to cause the actuating pin 36 to move out of one of the long slots 32 of the J-slot profile 29. When this pulling force is released, the actuating pin 36 tracks across the J-slot profile 29 and become located in one of the short slots 34. This causes the running tool slips 22 to return to the retracted configuration which is assisted by the bias force of flat springs 23. This feature allows the position of the running tool within the well bore to be adjusted if it is found that the assembly has not been positioned at the correct depth on the first attempt. Moreover, by making the J-slot profile 29 continuous, repeated indexing can be used if required, for example if difficulties such as jamming occurs during the landing or setting operations.

Once the running tool slips 22 are locked in engagement with the bore wall, further downward movement of the running tool 12 and downhole tool 10 relative to the well bore is prevented.

The running tool 12 is releasably coupled to the bridge plug 10 by a release mechanism that allows the transfer of axial force from the set running tool 12 to the bridge plug 10.

The running tool 12 is further provided with a set of load transfer keys 40 constrained to move axially downwardly along a keyway 41 provided in the slotted sub 21. The load transfer keys 40 are retained in position using a key retainer sleeve 42 coaxially mounted on the slotted sub 21, the key retainer sleeve being mechanically coupled with a lower outer sleeve 44 positioned at the lowermost end of the running tool 12.

At its upper end 52, the bridge plug 10 is provided with an external or internal fishing neck 50 coaxially mounted on an upper inner mandrel 56 of the bridge plug 10. The fishing neck 50 is shaped to be engageable with a correspondingly shaped fishing tool (described in greater detail below with reference to FIG. 6) to facilitate retrieval of the bridge plug 10 after it is set. The fishing neck 50 is capable of axial movement relative to the upper inner mandrel 56 in one direction only, the fishing neck 50 being releasably coupled to the upper inner mandrel using a ratchet mechanism 61 described in greater detail below. Application of a downward axial force to fishing neck 50 causes it to move downwardly relative to the upper inner mandrel 56.

When the running tool 12 and bridge plug 10 are coupled to form the assembly that is run into the well bore, a lower bearing surface 46 of the lower outer sleeve 44 is brought into abutting contact with an upper bearing surface 48 of the fishing neck 50. In order to set the position of the bridge plug 10, a downward jarring force is applied to the running tool 12, causing the load transfer keys 40 to move downwardly along the keyway 41. This downward force is transferred to the bridge plug 10 across the abutting surfaces 46 and 48. The downward jarring force is preferably applied using a jarring tool used on a slickline, wireline or coiled tubing tool string (not shown). The jarring tool may be hydraulic or mechanical provided only that it is able to apply a repeated axial jarring force through the running tool 12 to the downhole tool 10.

Movement of the fishing neck 50 relative to the upper inner mandrel 56 during the running operation is prevented by releasably coupling the fishing neck 50 to the upper inner mandrel using one or more downhole tool setting shear screws 58. When the downward jarring force is applied, sufficient force must first be applied to shear the downhole tool setting shear screws 58 to allow downward movement of the fishing neck 50 relative to the upper inner mandrel 56.

The bridge plug 10 is further provided with a downhole tool anchoring means 74 mounted on a mid inner mandrel 45. The mid inner mandrel 45 is positioned below the upper inner mandrel 56 and threadedly connected thereto. The downhole tool anchoring means 74 is controllably reconfigurable from a retracted configuration shown in FIG. 1 to permit movement of the downhole tool 10 through the well bore to a radially expanded configuration shown in FIG. 3 for releasably engaging the cased well bore. The downhole tool anchoring means 74 is biased towards the retracted configuration using a biasing means 75 in the form of one or more garter springs.

In the illustrated embodiments, the downhole tool anchoring means 74 is in the form of a set of interconnected upper and lower downhole tool slips 81 and 83, respectively. The set of upper and lower downhole tool slips 81 and 83 operates in a similar fashion to that described above with reference to the running tool slips 22. The main difference between the downhole tool anchoring means 74 and the running tool anchoring means 22 is the way in which the slips are actuated into the expanded configuration.

Expansion of the upper slips 81 is facilitated by allowing axial movement of an upper slips cone 76 towards the upper slips 81. At the same time, the interconnected lower slips 83 which are in a fixed spaced apart arrangement with the upper slips 81 extend radially outwardly by running up the frusto-conical outer surface of a lower slips cone 78. Expansion of the downhole tool anchoring means 74 is prevented whilst the assembly is being run into the well bore and until after the running tool has been landed and anchored by the presence of the downhole tool setting shear screws 72.

After shearing of the downhole tool setting shear screws 58, further downward jarring causes further downward travel of the fishing neck 50 relative to the upper inner mandrel 56 to compress a sealing means 60 mounted on the inner mandrel 45. In the illustrated embodiment of FIG. 3, the sealing means 60 is in the form of a resiliently compressible elastomeric packing element. Other suitable sealing means may equally be employed provided only that the sealing means is capable of sealing engagement with the internal diameter of a well bore upon application of a downwardly applied force. The sealing means 60 has a retracted or collapsed configuration in which the outside diameter of the sealing means is smaller than the internal diameter of the well bore, as illustrated in FIG. 1, and a radially expanded configuration for sealing engagement with the bore wall, as illustrated in FIG. 3.

To prevent retraction of the expanded elastomeric packing element 60 between successive jars, the bridge plug 10 is provided with a downhole tool setting means in the form of a ratchet 61 which allows axial downward axial movement of the fishing neck 50 relative to the upper inner mandrel 56 to cause expansion of the elastomeric packing element 60 and downhole tool anchoring means 74, whilst concomitantly resisting upward movement of the fishing neck 50 relative to the upper inner mandrel 56. The ratchet 61 comprises a ratchet ring 62 in toothed engagement with a matching ratchet sleeve 64. The ratchet ring 62 is mechanically coupled with a portion of the fishing neck 50. The ratchet sleeve 64 is mounted on the upper inner mandrel 56. In order to facilitate subsequent retrieval of the downhole tool 10 after it has been set, the ratchet 61 includes a shearable release mechanism described in greater detail below.

The downhole tool is further provided with a relaxation buffer spring 70 housed in a spring housing 71 mounted on the mid inner mandrel 45. During use of the downhole tool in the well, movement of the elastomeric packing element 60 may occur due to relaxation of the elastomeric material over time. This could cause a relaxation of the force being applied to the downhole tool slips 74 by upper and lower cones 76 and 78 respectively. The relaxation buffer spring 70 is included in the design of the preferred embodiment of the present invention to assist in retaining the force applied to upper cone 76 in the event that the elastomeric packing element 60 relaxes.

During the setting of the sealing means 60, the downhole tool anchoring means 74 is maintained in the retracted configuration. This is achieved by preventing axial movement of the upper cone 76 relative to the mid inner mandrel 45 until a downhole tool slips release shear screw 72 (best seen in FIG. 2) is sheared. Shearing occurs when the energy stored in the elastomeric packing element 60 and relaxation buffer spring 70 eventually exceeds the shear rating of the downhole tool slips release shear screw 72.

Thereafter, further downward jarring force applied by the jarring tool to the upper end 14 of the running tool 12 causes downward axial movement of the upper cone 76 towards the upper slips 81 expanding the downhole tool anchoring means 74 radially outwardly into locking engagement with the bore wall. As the upper slips 81 extends, so does the lower slips 83 which is fixed thereto. The teeth of upper and lower slips 81 and 83 are oriented to anchor the downhole tool 10 bi-directionally.

With the downhole tool anchoring means 74 in locking engagement with the bore wall, the downhole tool is set. Further downward jarring through the jar tool string may be applied to ensure that the sealing means 60 is fully expanded in sealing engagement with the bore wall. The ratchet 61 holds both the sealing means 60 and downhole tool anchoring means 74 in their respective expanded configurations.

Once the downhole tool 10 has been set, the running tool 12 may then be released from the downhole tool 10 and recovered to the surface by applying an upward pulling force sufficient to cause shearing of one ore more release shear pins 54 (best seen in FIG. 2). The release shear pins 54 are used to releasably couple the slotted sub 21 of the running tool 12 with the upper inner mandrel 56 of the downhole tool 10. To ensure that the various shear screws or shear pins used are sheared in the correct sequence, the tool release shear pins 54 have a much higher shear rating than the downhole tool setting shear screws 58.

Once the tool release shear pins 54 have been sheared, further upward jarring causes retraction of the extended running tool slips 22 into the retracted configuration by moving the expansion cone 26 away from the running tool slips 22. The flat springs 23 assist in the retraction of the running tool slips 22. The floating ring 27 allows the bow springs 24 to collapse for passage of the running tool past any restrictions in the well bore.

During this pulling operation, the actuating pin 36 will "fall" back down one of the long legs 32 of the J-slot profile 29 and then be positioned below the start of the next short leg 34 without actually entering the short leg 32 at this time. If a downwards movement back into the well bore occurs during recovery, the actuating pin 36 will locate within the short leg 34 preventing the running tool slips 22 from expanding. This action allows the downhole tool running tool to be able to move unhindered both out and in the well bore.

Figure 5:
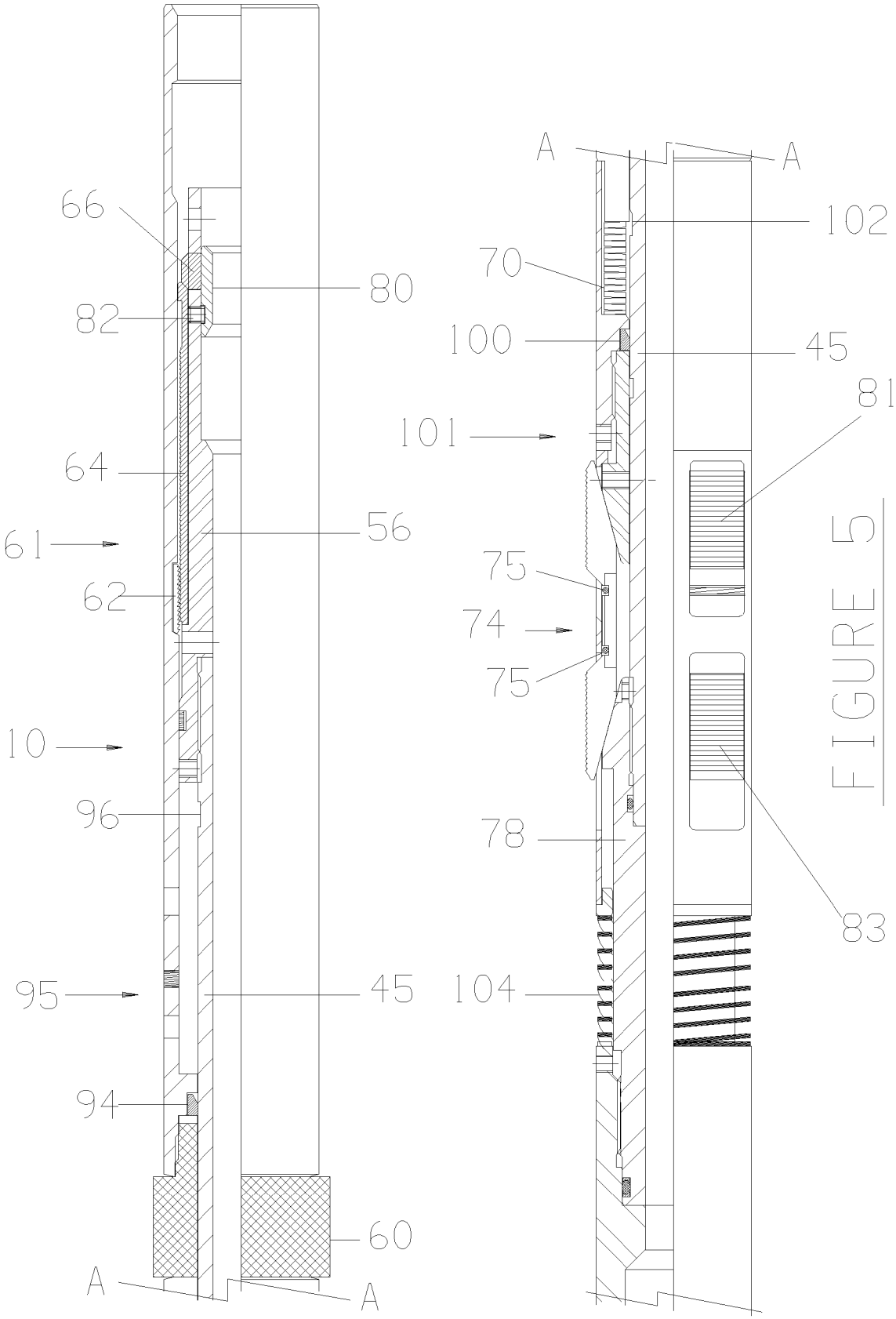
FIG. 5 is split into two portions for the interest of clarity and provides a half-sectional view of the bridge plug of FIG. 1 shown in its set configuration in the well bore, where line A-A shown at the ends of the two portions in FIG. 5 represents a break and continuation between the corresponding ends.

FIG. 5 shows the configuration of the set downhole tool 10 after removal of the running tool 12.

It is to be understood that the design of the downhole tool 10 lends itself to deployment downhole by means other than slickline wire, including but not limited to: electric line; coiled tubing; or drilled pipe, which may not require the use of any running tool. It is to be further understood that the anchoring and/or sealing means of the downhole tool may equally be set without the use of the running tool described above by using other means to apply the jarring force, for example, a hydraulic pressure delivered from the surface, a pyrotechnic setting device, a well pressure activated setting device or an electro-mechanical setting device. Thus, the present invention is not limited to the running tool and downhole tool being used together. Similarly, the running tool described above may be used independently of the downhole tool to carry other downhole equipment such as a measuring device into the well bore.

Figure 6:
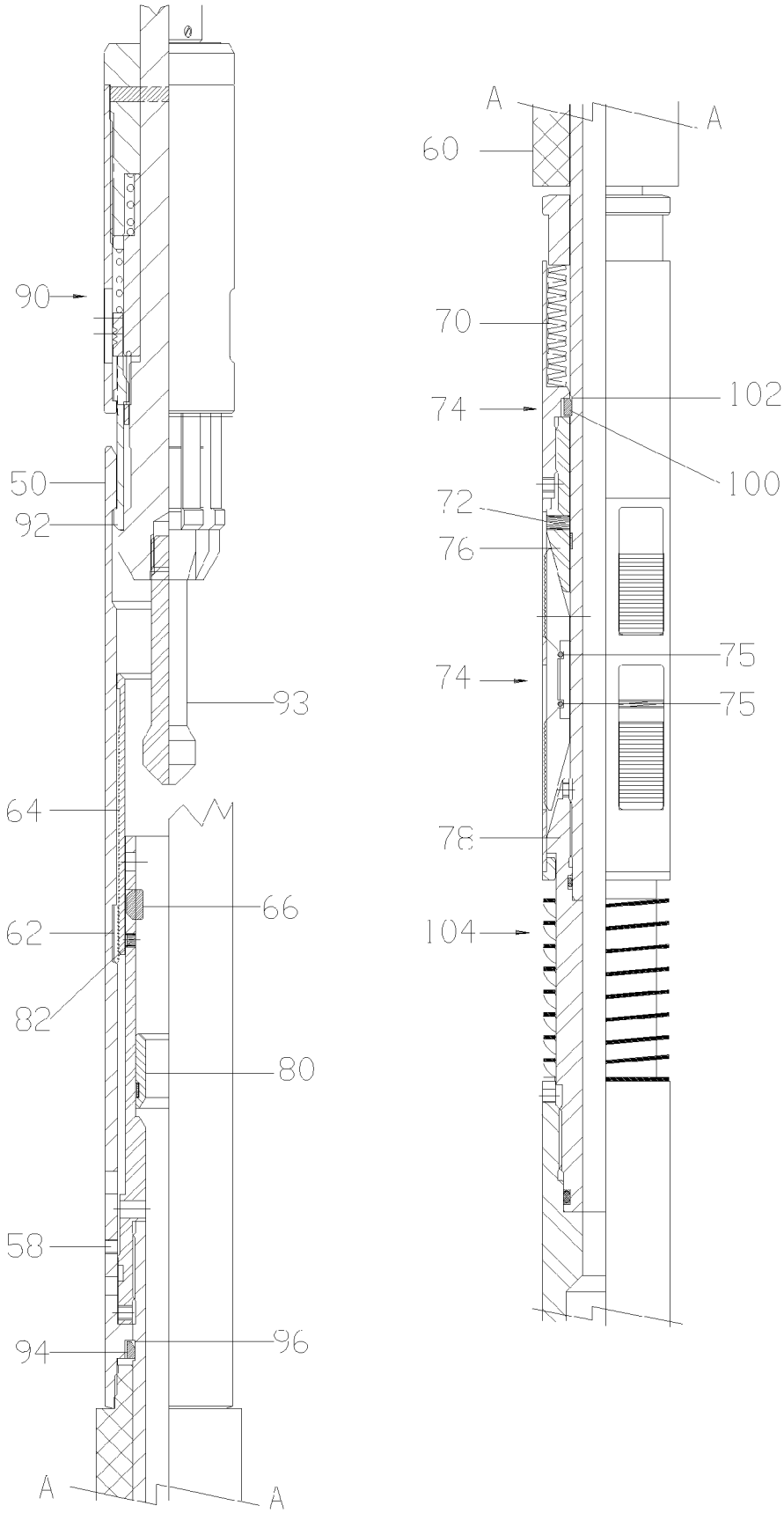
FIG. 6 is split into two portions for the interest of clarity and provides a half-sectional view of a fishing tool being used to retrieve the set bridge plug of FIG. 5 from the well-bore, where line A-A shown at the ends of the two portions in FIG. 6 represents a break and continuation between the corresponding ends.
Figure 7:
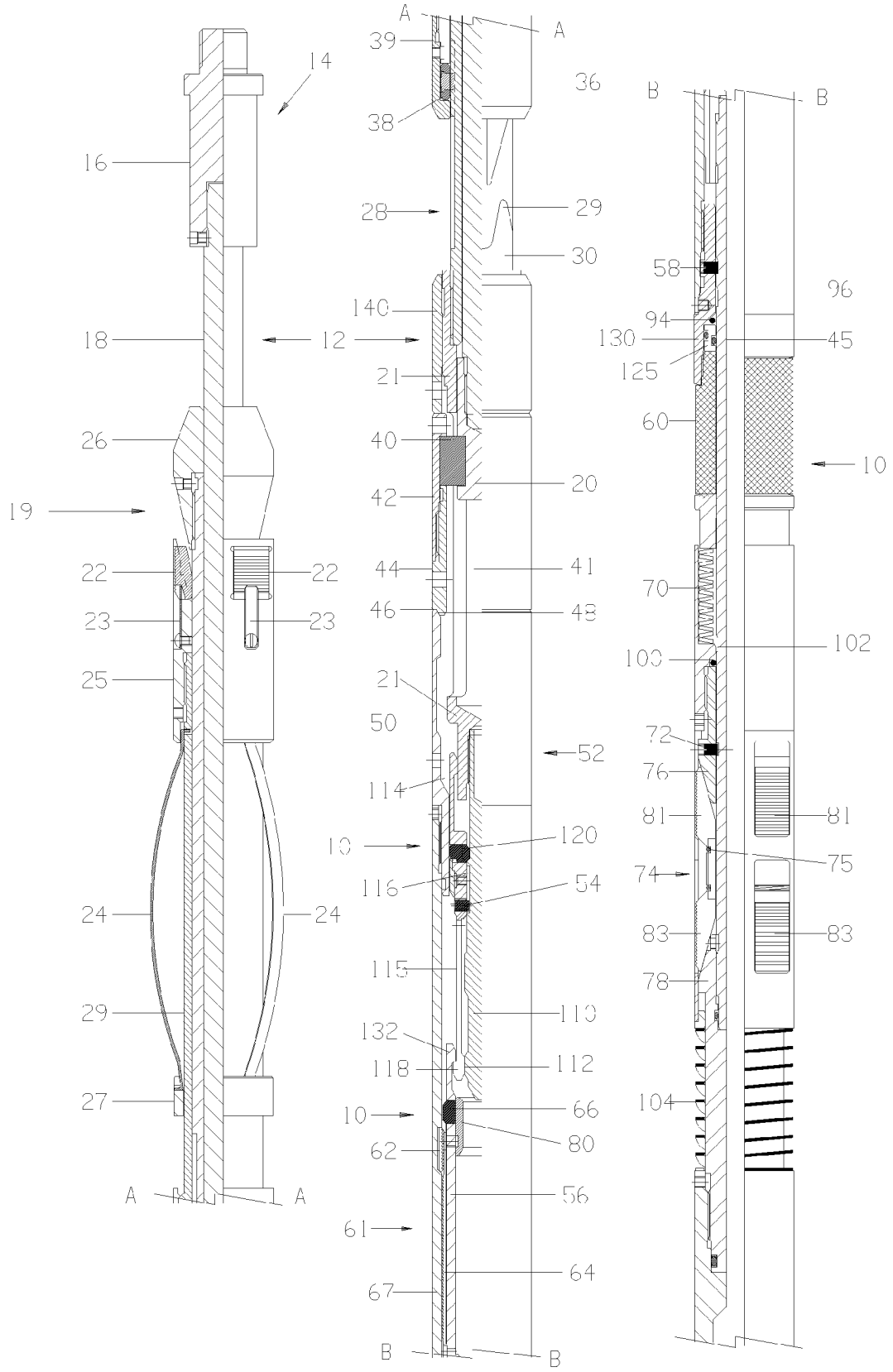
FIG. 7 is split into three portions for the interest of clarity and provides a half-sectional view of a second embodiment of a running tool and downhole tool assembly shown in a configuration suitable for running the assembly into a well bore, where lines A-A and B-B shown at the corresponding ends of adjacent portions in FIG. 7 represent a break and continuation between the corresponding ends.
Figure 8:
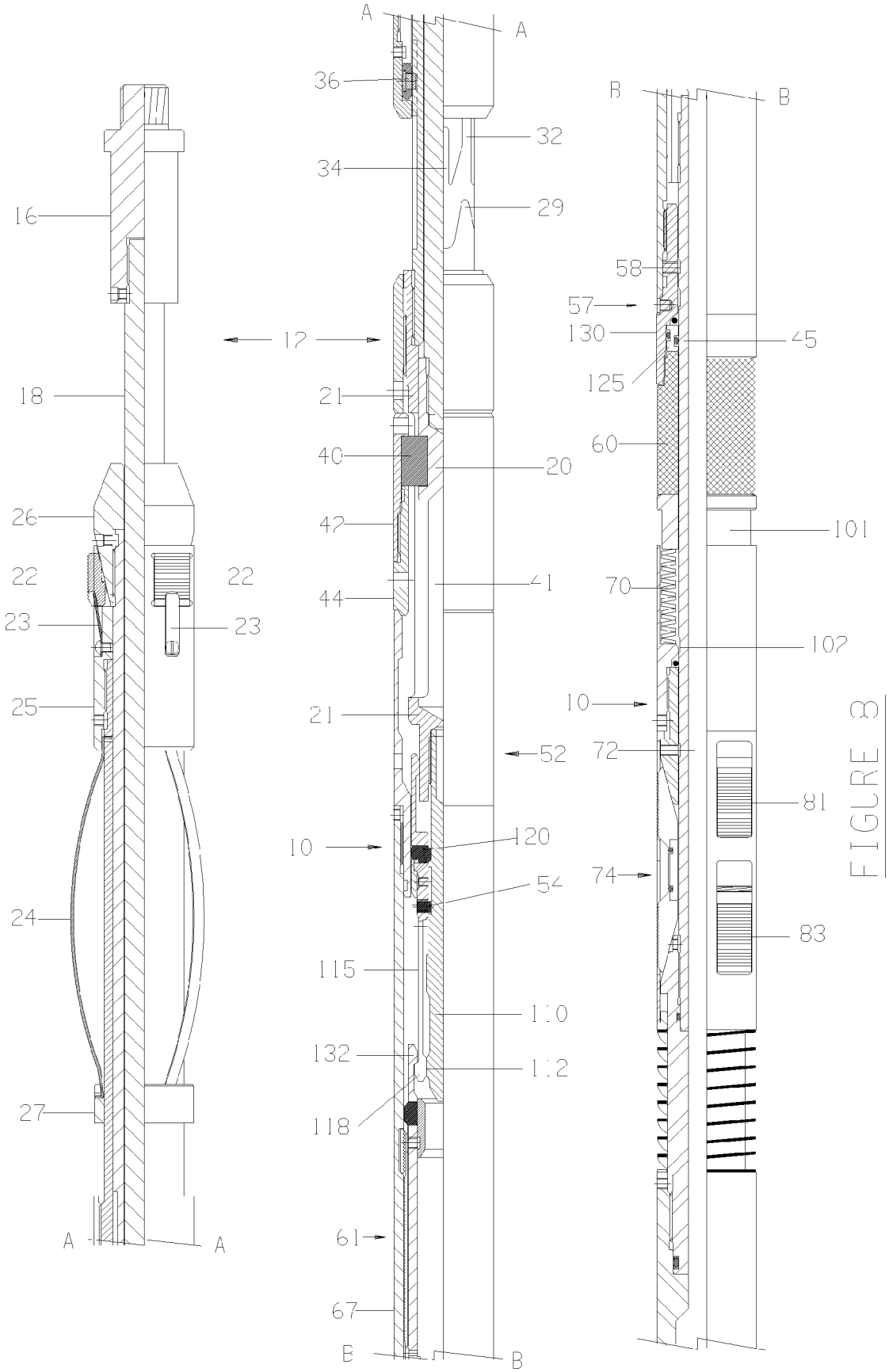
FIG. 8 is split into three portions for the interest of clarity and provides a half-sectional view of the running tool and downhole tool assembly of FIG. 7 shown in a configuration suitable for landing the assembly in the well bore, where lines A-A and B-B shown at the corresponding ends of adjacent portions in FIG. 8 represent a break and continuation between the corresponding ends.

If it becomes necessary to retrieve the set downhole tool 10 from the well bore, the sealing means 60 and downhole tool anchoring means 74 first needs to be reconfigured into the retracted configuration illustrated in FIG. 6. This can only be achieved by disengaging the ratchet 61 which is achieved by releasing a release mechanism comprising one or more ratchet release keys 66 retained by a key retaining sleeve 80 mounted internally on the upper inner mandrel 56 of the downhole tool 10. The key retaining sleeve 80 is held against axial movement by a ratchet release shear screw 82 (best seen in FIG. 5).

With reference to FIG. 6, a fishing tool 90 is run into the well, the fishing tool 90 being provided with a fishing head 92 for engagement with the fishing neck 50 of the downhole tool 10. The fishing tool 90 is further provided with a prong 93 for applying a downward force to the key retaining sleeve 80. Sufficient downward force is applied by the prong 93 to the key retaining sleeve 80 to overcome the shear rating of the ratchet release shear screws 82. When the ratchet release shear screws 82 shear, the key retaining sleeve 80 is free to slide axially downwardly, causing the ratchet release keys 66 to fall inwards. In this way, the ratchet 61 is disengaged, allowing the ratchet sleeve 64 to slide upwardly to release the energy stored in the expanded sealing means 60 and relaxation buffer spring 70. Thereafter, further application of an upward pulling force to the downhole tool causes further retraction of the sealing means 60 and further relaxation of the relaxation buffer spring 70.

In order to prevent re-expansion of the downhole tool sealing means 60 during retrieval of the downhole tool 10, the downhole tool 10 is further provided with a first positive locking means 95 for locking the downhole tool sealing means in the retracted configuration. In the illustrated example of FIG. 5, the first positive locking means 95 comprises a first snap ring 94 locatable in a first groove 96 machined into the mid inner mandrel 45. The first positive locking means 95 is locked into position by application of sufficient pulling force to the downhole tool 10 after release of the ratchet release keys 66, until the first snap ring 94 becomes located in the first groove 96. Once locked, the first positive locking means 95 prevents re-expansion of the sealing means 60 and buffer spring 70 during retrieval.

Once the first positive locking means 95 has been locked, the application of a downward force to fishing tool 90 may be used if required to encourage retraction of the downhole tool anchoring means 74, the downward force being transmitted through the mid inner mandrel 45 to the lower cone 78. Downhole tool slips biasing means 75 in the form of garter springs assist retraction of the downhole tool anchoring means 74.

A second positive locking means 101 in the form of a second snap ring 100 and a second groove 102 provided in the mid inner mandrel 45 to lock the downhole tool anchoring means 74 in the retracted configuration during retrieval of the downhole tool. The second snap ring 100 is caused to become located in the second groove 102 upon application of an upward pulling force to the downhole tool 10. The second locking means 101 locks the upper cone 76 to the mid-inner mandrel 45 when the second snap ring 100 becomes located in the second groove 102 as illustrated in FIG. 6. The downhole tool 10 is further provided with a retrieval bias means 104 in the form of a spring to assist in locating the second snap ring 100 in the groove 102.

Without the second locking means 101 being provided, the downhole tool anchoring means 74 may try to re-expand should any part of the tool at or below the elastomeric packing element 60 become snagged whilst the bridge downhole tool 10 is being pulled upwardly during retrieval. Alternatively, the sealing means 60 itself may fail due to circumferential rupture of the elastomeric packing element, causing the elastomer to break into two separate rings. This is a common source of failure of elastomeric packing elements downhole. In this event, a lower section of the ruptured elastomeric packing element 60 would be unrestrained and may swell, depending on well conditions. A swollen section of a ruptured elastomeric packing element 60 would be likely to catch in a well during recovery of the bridge downhole tool 10. If this were to occur, a compression force would be applied to the upper cone 76, which may cause the downhole tool anchoring means 74 to re-expand into engagement with the bore wall.

Prior to or during retrieval of the bridge downhole tool 10, it is highly recommended that a check is undertaken to ensure that no differential pressure exists across the bridge downhole tool 10 before the downhole tool anchoring means 74 are released. Failure to do so may result in a sudden uncontrolled movement of the bridge downhole tool 10 either up or down the tubing. Pressure equalisation is typically achieved by means of providing a pressure equalisation device (not shown) being positioned on the downhole tool 10 towards a lowermost end of the downhole tool below the sealing means 60.

A second embodiment of the present invention is illustrated in FIGS. 7 to 12 for which like reference numerals refer to like parts. The release mechanism between the running tool 12 and the downhole tool 10 has been changed to provide an emergency release feature. In this embodiment the slotted sub 21 is retained on the J-mandrel 30 of the running tool and a retaining sleeve 140 in abutting contact with fishing neck sleeve 42 is used to maintain a close fit between running tool 10 and the downhole tool 12. An extension piece 110 is threadedly engaged with the lowermost end of the slotted sub 21, the extension piece being provided with a failsafe release mechanism comprising a set of keys 120 which are used to protect the shear screws 54 from experiencing any load during the setting of the downhole tool anchoring means 74. If the release shear screw 54 shears prematurely, there is a risk that the downhole tool 10 could fall to the bottom of the well. The keys 120 are held in place between the internal diameter of the fishing neck sleeve 50 and the outer diameter of the extension piece 110. A collet 116 is mechanically coupled with the lower end of the slotted sub 21 and coaxially mounted on the extension piece 110. The collet 116 terminates at its lowermost end in a set of expandable fingers 118 held in a radially expanded configuration by an expanded head section 112 of the extension piece 110. The collet fingers 118 are provided with an offset that engages with a correspondingly shaped recess 132 in the uppermost end of the upper inner mandrel 56 of the downhole tool 10.

Figure 9:
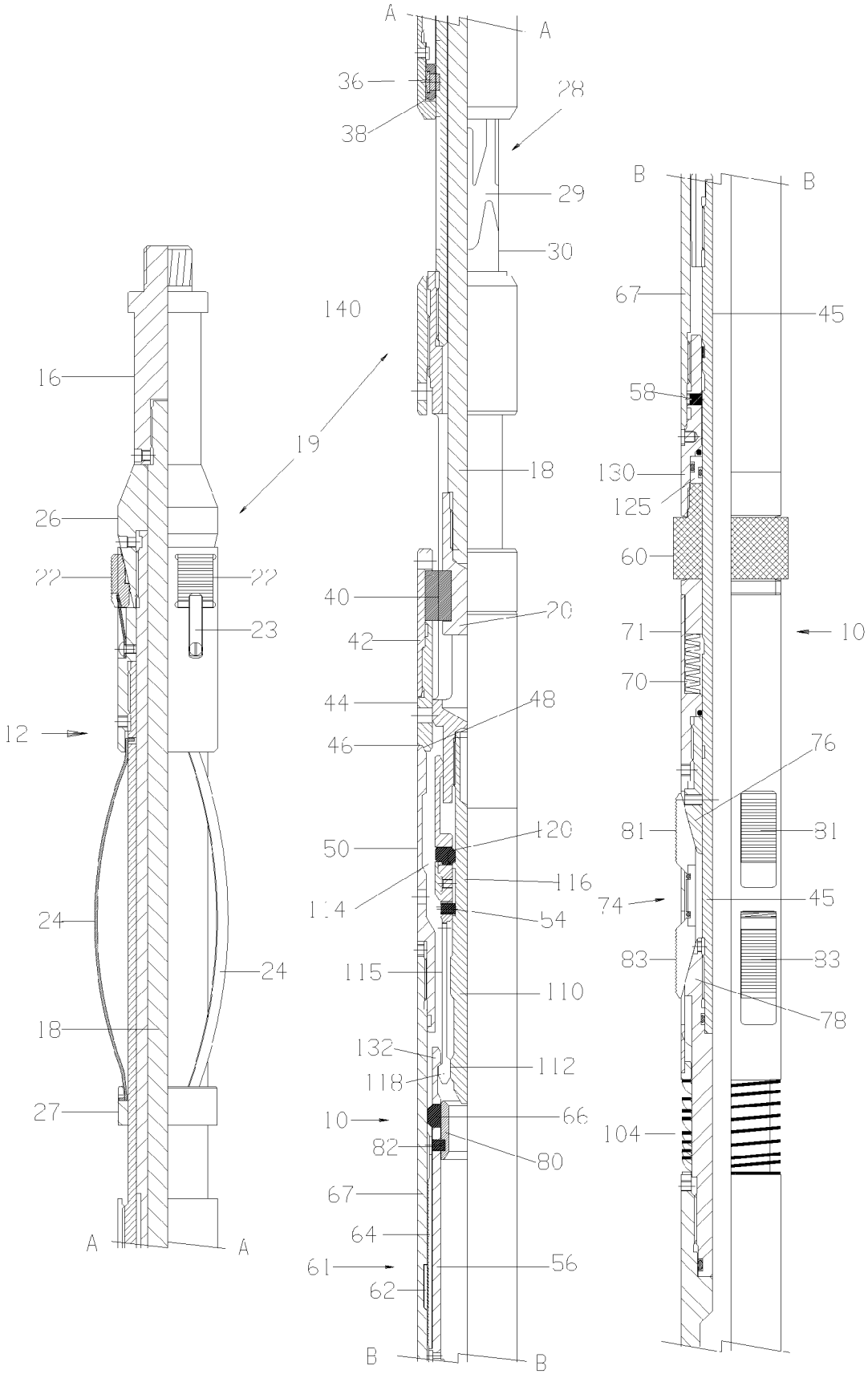
FIG. 9 is split into three portions for the interest of clarity and provides a half-sectional view of the running tool and downhole tool assembly of FIG. 7 shown in a configuration suitable for setting the downhole tool anchoring means in the well bore, where lines A-A and B-B shown at the corresponding ends of adjacent portions in FIG. 9 represent a break and continuation between the corresponding ends.
Figure 10:
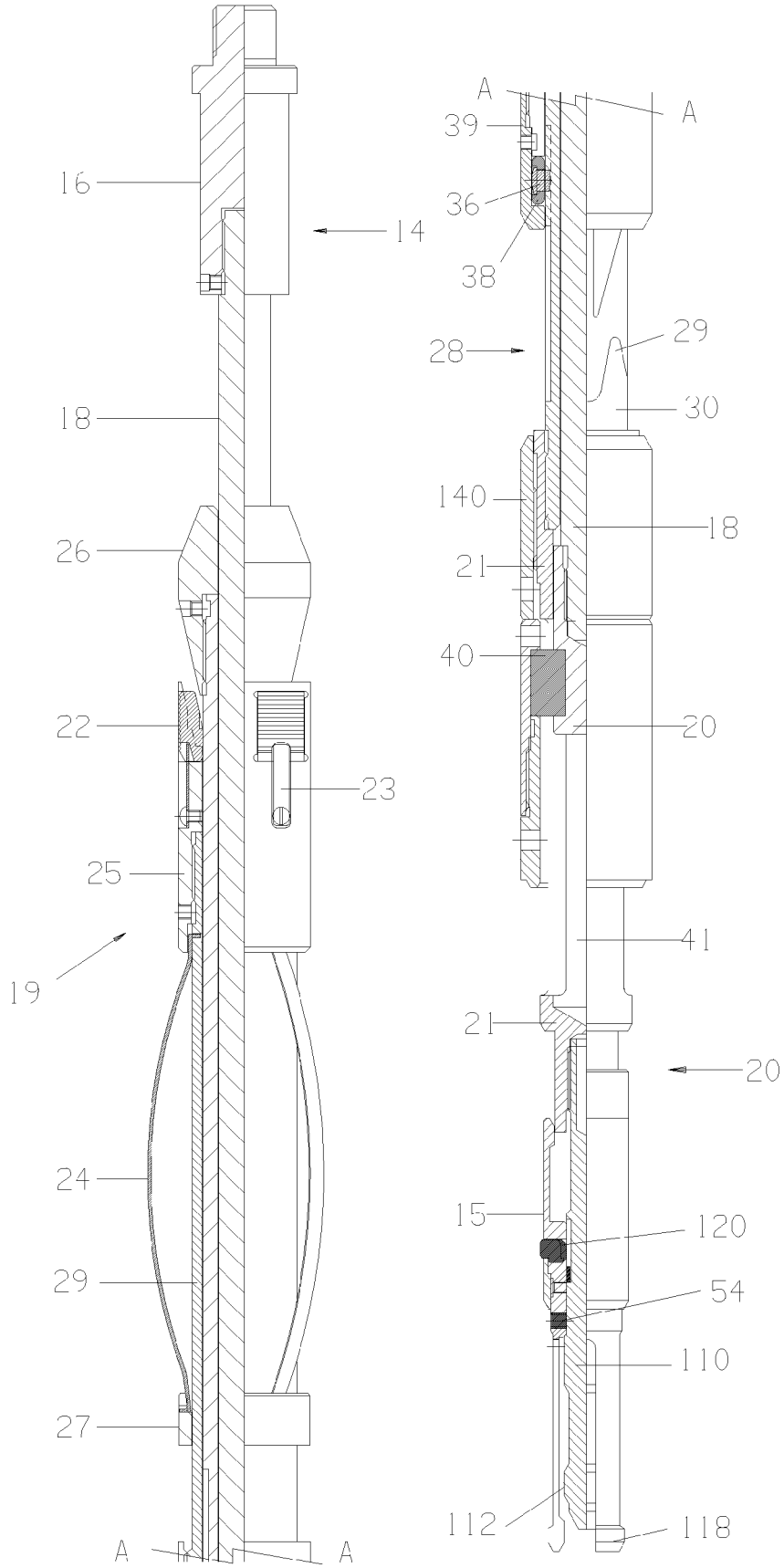
FIG. 10 is split into two portions for the interest of clarity and provides a half-sectional view of the running tool and downhole tool assembly of FIG. 7 shown in a configuration suitable for retrieval of the running tool from its set position in the well bore, where line A-A shown at the ends of the two portions in FIG. 10 represents a break and continuation between the corresponding ends.
Figure 11:
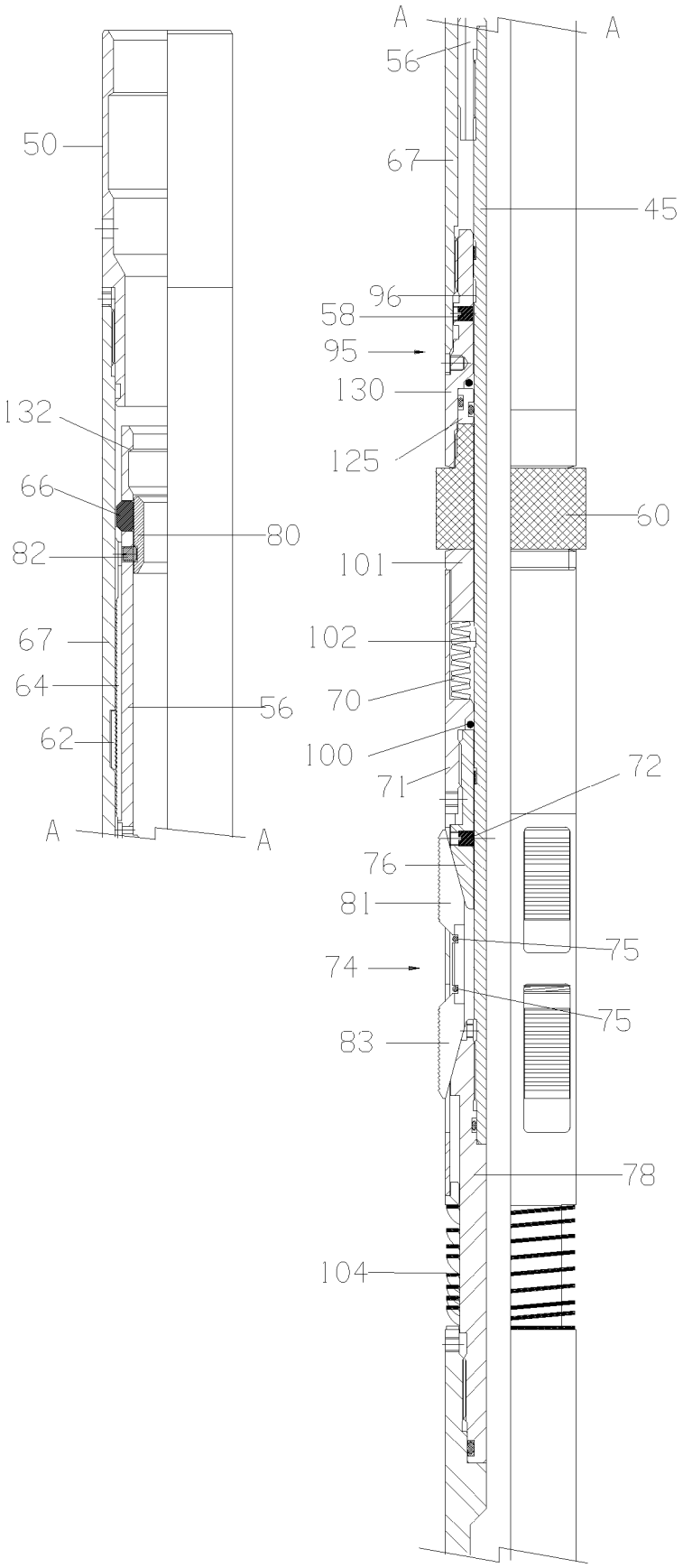
FIG. 11 is split into two portions for the interest of clarity and provides a half-sectional view of the downhole tool of FIG. 7 shown in its set configuration in the well bore, where line A-A shown at the ends of the two portions in FIG. 11 represents a break and continuation between the corresponding ends.
Figure 12:
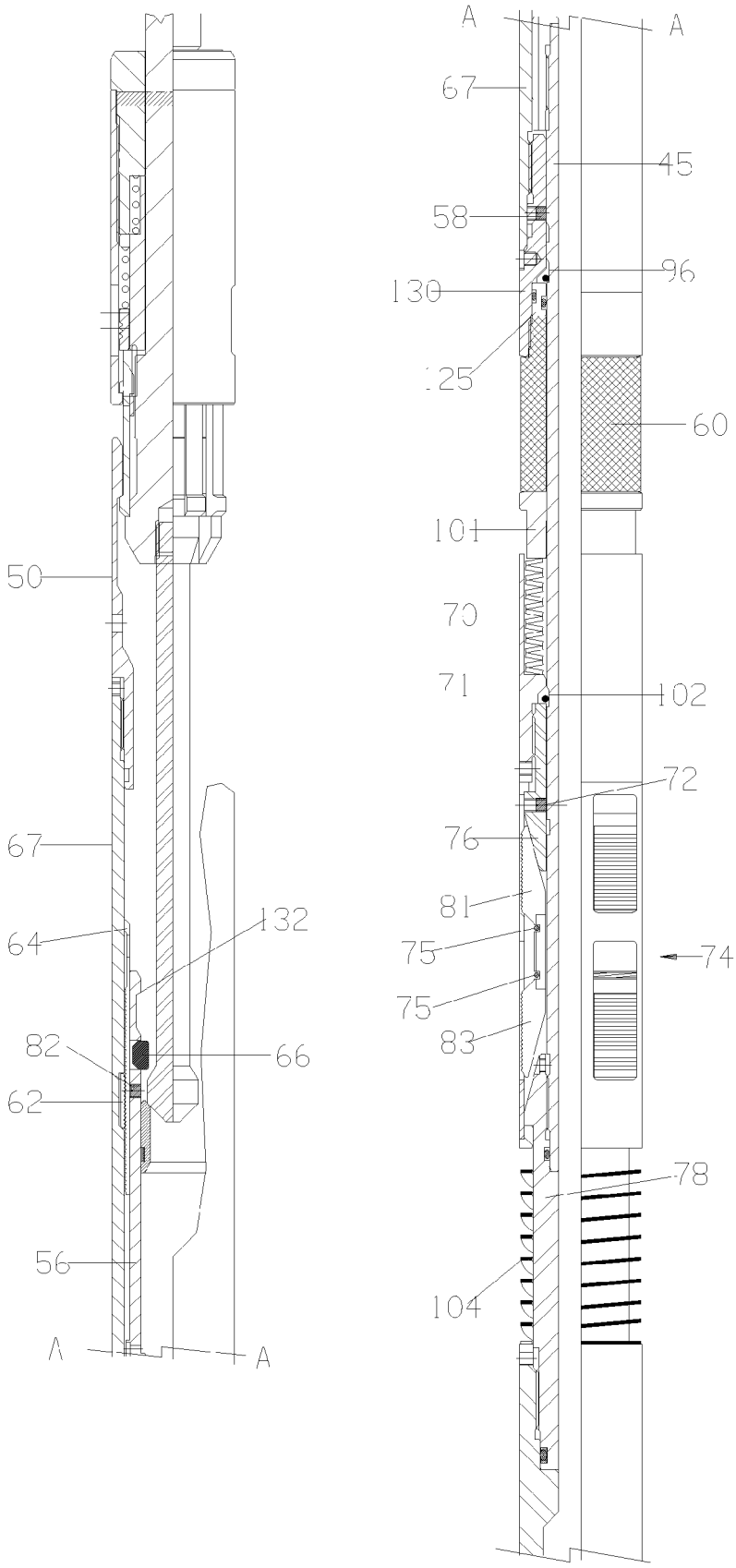
FIG. 12 is split into two portions for the interest of clarity and provides a half-sectional view of a fishing tool being used to retrieve the set downhole tool of FIG. 11 from the well bore, where line A-A shown at the ends of the two portions in FIG. 12 represents a break and continuation between the corresponding ends; and, FIG. 13 is a view of a downhole tools set in a well bore with a measuring device suspended from the lowermost end of the downhole tool for monitoring one or more well parameters, where line A-A shown at the ends of the two portions in FIG. 10 represents a break and continuation between the corresponding ends.

During downward jarring, the keys 120 are retained in position while the load transfer keys 40 are caused to travel along keyway 41 thereby driving the fishing neck 50 downwardly relative to the positions of the extension piece 110 and mid inner mandrel 56. As best seen in FIG. 9, when sufficient downward jarring has been applied to reconfigure the downhole tool anchoring means 74 into the expanded configuration, the keys 120 are no longer retained by the inner diameter of the fishing neck 50 and are released outwardly into the cavity 114.

Once the keys 120 have been released into the cavity 114, the release shear screws 54 are able to be sheared by the application of an upward jarring force to release the running tool 12 from the set downhole tool 10 as described above. When the release shear screws 54 shear, the extension piece 110 is released to move upwardly relative to the collet 116. The expanded collet fingers 115 are no longer held in the expanded configuration by the head portion 112 of the extension piece 110. When the collet fingers 115 retract, the lowermost ends 118 are released from the recess provided in the uppermost end 132 of the mid inner mandrel 56, releasing the running tool 12 from the downhole tool 10.

Further modifications have been made to the downhole tool in this embodiment. To provide pressure integrity against the flow of fluids past the sealing means 60, an O-ring has been positioned above the depth of the sealing means 60 and retained using an O-ring seal support ring 125. An upper outer sleeve 67 has been added to provide a cover for the downhole tool setting shear screws 58 with a retaining sleeve 130 holding the O-ring seal support ring 125 in place.

In each of the described embodiments, the downhole tool is being used as a bridge plug and accordingly is provided with expandable sealing means. The downhole tool could equally be used for the setting of a measuring device for monitoring one or more well parameters, the measuring device being attached typically to a lowermost end of the downhole tool as shown in FIG. 13 for which like reference numerals refer to like parts. In this embodiment, the bore of the mid inner mandrel 45 of the downhole tool 12 is hollow to allow for the passage of fluids such as hydrocarbons, oil, gas or water through the bore of the downhole tool. The downhole tool 12 in this illustrated example is not provided with a sealing means 60 but is anchored into position within the well bore using the downhole tool anchoring means 74 in the same ways as described above. In place of the sealing means 60 the downhole tool is optionally fitted with a vibration attenuation assembly 155 comprising at least one spring 153 retained on the mid inner mandrel 45 by a spring housing 151, and a spring pusher 152. The vibration attenuation assembly may be included to offset vibration in the downhole tool due to the flow of fluids through and around the downhole tool once set.

The lowermost end of the downhole tool 12 is fitted with a measuring device suspension assembly 160 comprising a ported tool suspension sub or gauge hanger 150 to which a measuring device 162 is coupled. The gauge hanger 150 is provided with one or more flow ports 156 to permit the passage of fluids through the bore of the mid inner mandrel 45 of the downhole tool 12.

Once set in the well, the measuring device may be used to monitor or record data within the well while the well is flowing. It should be noted that when the downhole tool is being used as a bridge plug, flow of fluids through the bore of the inner mandrel is prevented. The downhole tool of FIG. 13 is able to be retrieved from the well bore in the same manner as described above in relation to the first and second embodiment of the present invention.

Now that the preferred embodiments and illustrative examples of the present invention have been described in detail, the present invention has a number of advantages over the prior art, including the following:

(a) the downhole tool can be landed at any position within a known size of a cased well bore without needing any interaction between the downhole tool or the running tool and any restriction or recesses in the well to actuate either the downhole tool or the running tool;

(b) the downhole tool has a larger internal diameter than other prior art devices, with the complexity of the landing and anchoring means being moved from the downhole tool to the running tool, which can then be used for multiple downhole tools;

(c) the downhole tool left downhole also has the potential to be shorter than prior art devices which is advantageous given that most wells have some degree of deviation and tortuosity;

(d) the setting of the downhole tool is less complicated in that once the running tool has been anchored in position by application of an upward force, thereafter only downward forces are used to lock the downhole tool in position;

(e) the slips on the downhole tool are positioned below the downhole tool sealing means which protects the slips from debris that may fall down the well bore;

(f) the use of the positive locking means allows for the option of abandoning the downhole tool to the bottom of the well if the downhole tool becomes unable to be retrieved for any reason; and, (g) the running tool itself does not have any shear screws or seals, which makes it easier to strip down and re-use than the prior art running tools used for prior art downhole tools.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description and the appended claims.

The invention claimed is:

1. A downhole tool/running tool system for retrievably setting the downhole tool at any location within a well bore, the system comprising:

a running tool comprising an inner rod, a running tool anchoring means mounted on the inner rod and controllably reconfigurable between a retracted configuration to permit movement of the tool through the well bore and a radially extended configuration for locking engagement of the running tool with the bore wall, a running tool actuating assembly for effecting reciprocal movement of the reconfiguring the running tool anchoring means to and from the retracted and expanded configurations without interacting with any restrictions or recesses within the well bore, the tool actuating assembly being moveable from a first configuration in which the tool anchoring means is retracted and a second configuration in which the tool anchoring means is expanded in response to the application of an axial force, and, a resistance means for frictionally engaging the bore wall with sufficient gripping force so as to hold the position of the running tool relative to the well bore during movement of the running tool actuating assembly to and from the first and second configuration upon application of the axial force;

a downhole tool comprising a mandrel, a downhole tool anchoring means mounted on the mandrel and reconfigurable from a retracted configuration to permit movement of the downhole tool through the well bore to a radially expanded configuration for releasably engaging the cased well bore, the downhole tool anchoring means being biased towards the retracted configuration, and, a downhole tool setting means for resisting movement of the tool anchoring means from the expanded configuration back to the retracted configuration until a release mechanism is released to allow retraction of the downhole tool anchoring means and retrieval of the downhole tool from the well bore; and, means for releasably coupling the downhole tool with the running tool, said means facilitating transfer of axial loads between the running tool and downhole tool during landing and setting of the downhole tool in the well bore and arranged to release the running tool from the downhole tool upon application of an upward jarring force.

2. The downhole tool/running tool system of claim 1 wherein the means for releasably coupling the downhole tool with the running tool includes one or more load transfer keys axially moveable along a keyway in response to the application of an axial force whereby an axial force applied to the running tool is transmitted to the downhole tool.

3. The downhole tool/running tool system of claim 1 wherein the downhole tool further comprises a downhole tool sealing means mounted on the mandrel and moveable from a retracted configuration to permit movement of the downhole tool through a well bore and a radially expanded configuration for sealing engagement with the bore wall.

4. The downhole tool/running tool system of claim 1 further comprising one or more seals in combination with the sealing means for ensuring pressure integrity across the downhole tool sealing means when the downhole tool sealing means is in the radially expanded configuration.

5. The downhole tool/running tool system of claim 1 further comprising a measuring device for monitoring one or more well parameters.

6. A method of setting a downhole tool in a bore, the method comprising the steps of a) coupling a downhole tool with a running tool so as to form a running tool/downhole tool assembly, wherein the downhole tool comprises a mandrel, a downhole tool anchoring means mounted on the mandrel and reconfigurable from a retracted configuration to permit movement of the downhole tool through the well bore to a radially expanded configuration for releasably engaging the cased well bore, the downhole tool anchoring means being biased toward the retracted configuration, a downhole tool setting means for resisting movement of the tool anchoring means from the expanded configuration back to the retracted configuration until a release mechanism is released to allow retraction of the downhole tool anchoring means and retrieval of the downhole tool from the well bore, and one or more locking means for locking the downhole tool anchoring means in the retracted configuration after the release mechanism has been released, and wherein the running tool comprises an inner rod, a running tool anchoring means mounted on the inner rod and controllably reconfigurable between a retracted configuration to permit movement of the tool through the well bore and a radially extended configuration for locking engagement of the running tool with the bore wall, a running tool actuating assembly configured to effect reciprocal movement and reconfiguring of the running tool anchoring means to and from the retracted and expanded configurations without interacting with any restrictions or recesses within the well bore, the tool actuating assembly being moveable from a first configuration in which the tool anchoring means is retracted and a second configuration in which the tool anchoring means is expanded in response to the application of an axial force, and a resistance means for frictionally engaging the bore wall with sufficient gripping force so as to hold the position of the running tool relative to the well bore during movement of the running tool actuating assembly to and from the first and second configuration upon application of the axial force, the running tool actuating assembly comprising a J-slot mechanism including an actuating pin receivable in a J-slot profile, the J-slot profile having one or more short legs and one or more long legs, the actuating pin being constrained to move between a short leg and a long leg upon application of an axial pulling force to the tool actuating assembly such that, when the actuating pin is located in one of the short legs, the tool anchoring assembly is in the first configuration and, when the actuating pin is located in one of the long legs, the tool anchoring assembly is in the second configuration;

b) running the running tool/downhole tool assembly into the bore of a well to any desired location within the well bore, the running tool anchoring means and the downhole tool anchoring means being in their respective retracted configurations;

c) applying an axial force in a first direction to the running tool so as to reconfigure the running tool anchoring means into the expanded configuration;

d) thereafter applying an axial force in a second direction to reconfigure the downhole tool anchoring means into the expanded configuration in engagement with the bore wall so as to set the position of the downhole tool within the well bore; and e) thereafter releasing the running tool from the downhole tool for retrieval of the running tool from the well bore.

* * * * *